US010092478B1

(12) United States Patent
Amit

(10) Patent No.: US 10,092,478 B1
(45) Date of Patent: Oct. 9, 2018

(54) METHOD AND SYSTEM FOR TREATING SKIN ASSOCIATED WITH THE FACE AND NECK

(71) Applicant: Noah Amit, Haifa (IL)

(72) Inventor: Noah Amit, Haifa (IL)

( * ) Notice: Subject to any disclaimer, the term of this patent is extended or adjusted under 35 U.S.C. 154(b) by 0 days.

(21) Appl. No.: 15/696,683

(22) Filed: Sep. 6, 2017

(51) Int. Cl.
*A61H 7/00* (2006.01)

(52) U.S. Cl.
CPC ..... *A61H 7/001* (2013.01); *A61H 2201/1611* (2013.01); *A61H 2205/022* (2013.01); *A61H 2205/04* (2013.01)

(58) Field of Classification Search
CPC ..... A61H 7/00; A61H 7/001; A61H 7/002; A61H 7/003; A61H 7/006; A61H 7/007; A61H 11/00; A61H 11/02; A61H 39/00; A61H 39/02; A61H 99/00; A61H 2201/165; A45D 44/22; A45D 27/38; A61F 2013/0028
USPC ..... 606/201, 204.15, 204.35
See application file for complete search history.

(56) References Cited

U.S. PATENT DOCUMENTS

| | | | | | |
|---|---|---|---|---|---|
| 1,497,858 | A * | 6/1924 | Lewis | A45D 44/22 | 2/174 |
| 2,399,335 | A * | 4/1946 | Dunand | A45D 44/22 | 606/204.35 |
| 2,825,328 | A * | 3/1958 | Olsen | A61F 13/12 | 2/181 |
| 3,672,362 | A * | 6/1972 | Basche | A45D 44/22 | 606/204.35 |
| 4,646,728 | A * | 3/1987 | Takeda | A45D 44/22 | 128/97.1 |
| 5,555,900 | A * | 9/1996 | Rich | A45D 44/22 | 132/200 |
| 8,088,141 | B1 * | 1/2012 | Reyna | A45D 44/22 | 601/134 |
| 8,747,383 | B2 * | 6/2014 | Francis | A45D 44/22 | 604/20 |
| 2006/0106330 | A1 * | 5/2006 | Andrade | A61F 13/122 | 602/74 |

* cited by examiner

*Primary Examiner* — Michael Tsai
(74) *Attorney, Agent, or Firm* — Mark David Torche; Patwrite Law

(57) ABSTRACT

A complexion and neck treatment band (CNTB) for a user, by which compound mechanical stimulation is applied to the skin of the face and surrounding skin patches. The band fits around the head of the user, forming a tight fit with the skin of the complexion and possibly neck. The user can apply generalized stretch, and using special stretch lobes also apply localized stretch.

6 Claims, 5 Drawing Sheets

METHOD AND SYSTEM FOR TREATING SKIN ASSOCIATED WITH THE FACE AND NECK

FIELD OF THE INVENTION

The present invention relates to a system that is applied by a person to his/her complexion skin with the intention of ameliorating the physiological state of face skin and neck skin.

BACKGROUND OF THE INVENTION

Mechanical stretch of human tissue has been known to enhance collagen build up both in vitro, relating to pulmonary artery fibroblasts (Jia Liu et al. Mechanical stretching stimulates collagen synthesis via down-regulating SO2/AAT1 pathway. Sci. Rep. 6, 21112; doi: 10.1038/Srep 21112 (2016) and in vitro (see below). Stretching has been shown to regulate cellular proliferation in human epidermal keratinocytes (Soichiro Yano et al. "Mechanical stretching in vitro regulates signal transduction pathways and cellular proliferation in human epidermal keratinocytes." J. Invest. Dermatol. 122: 783-790, 2004. Further, in another research stretching has been demonstrated to affect epidermal thickness and develop the basement membrane in human skin equivalents in vitro. (Eijiro Tokuyama et al. Mechanical stretch on human skin equivalents increases the epidermal thickness and develops the basement membrane. Plos one DOI:10: 1371, 2015.

Another aspect of skin relating to personal care, cosmetics and medicine, is the hindrance which the outer layer of the skin presents to permeation of medicinal an conditioning agents. In this respect Trommer H and Neubert R. H. H. ("Overcoming the stratum corneum: the modulation of skin penetration", Skin pharmacol. physiol, 2005; 19:105-121. Chemical and physical methods of enhancing the penetration through the stratum corneum are discussed.

Wrinkles in the complexion skin and other places are a subject of numerous efforts aiming to evade or mitigate the phenomenon. For example J. L. Contet-Audonneau et al. in "A histological study of human wrinkle structure: comparison between sun—exposed areas of the face, with or without wrinkles and sun—protected areas" (Br. J. of Dermatol. 1999: 140: 1038-1047

SUMMARY OF THE INVENTION

In accordance with the present invention, a complexion and neck treating tool, referred to hereinafter as a CNTB is made in preferred embodiments from a stretchable, skin adhering material. The CNTB of the invention typically includes also stretch lobes for pulling down to apply localized upward stretch on the complexion (face) and possibly neck, after the CNTB is donned. Typically, above each lobe a longitudinal window is disposed in the CNTB for collecting slack skin produced in localized stretching. In some embodiments, two longer slits or windows are employed to allow specific donning below and above the ears of the user.

BRIEF DESCRIPTION OF THE DRAWINGS

The present invention will be understood and appreciated more fully from the following detailed description taken in conjunction with the appended drawings in which.

DETAILED DESCRIPTION OF THE INVENTION

The present invention is to do with a complexion and neck treatment band (CNTB), a typically stretchable device intended to be applied around the user's head for affecting a compound stretch. It is specifically formed to tightly fit encircling a human head and further produce a general stretch and localized stretching domains, to be regulated by the wearer (user). The structural features of an exemplary complexion treatment band CNTB are schematically described with reference to FIG. 1A. The CNTB 22 is typically made of thin stretchable material such as synthetic resin with silicone rubber being a preferred example.

As the CNTB is donned it attaches to the skin of the user, it can be pulled upwards en bloc, thereby stretching a large portion of the complexion skin, and possibly more. This kind of stretch is hereinafter referred to as general stretch.

The Stretch Lobes

These lobes facilitate the implementation of a localized stretch effect (LSE) by the device of the invention. It should be emphasized that the LSE is employed after affecting the generalized stretch effect (GSE) discussed above. Accordingly, when CNTB 22 is settled against the skin, any one of stretch lobes (SLs) 24, see also FIG. 1B, project downwards, can be gripped by the user's fingers, stretched further downwards, causing a deformation of the respective lobe and sometimes the CNTB, then the SL is made to adhere to the skin and further released. It would typically then pull a portion of the skin upwards towards the main body of CNTB 22 in its resilient recovery move. The stretch lobes may be surface—structured on the outside to assist grip. Such structures 26 may be for example cleats, grooves, or studs on the surface and or may be a portion of the CNTB inclined outwardly towards the bottom to resist slippage.

The Skin Surplus Windows (SSWs)

Figure 1A:
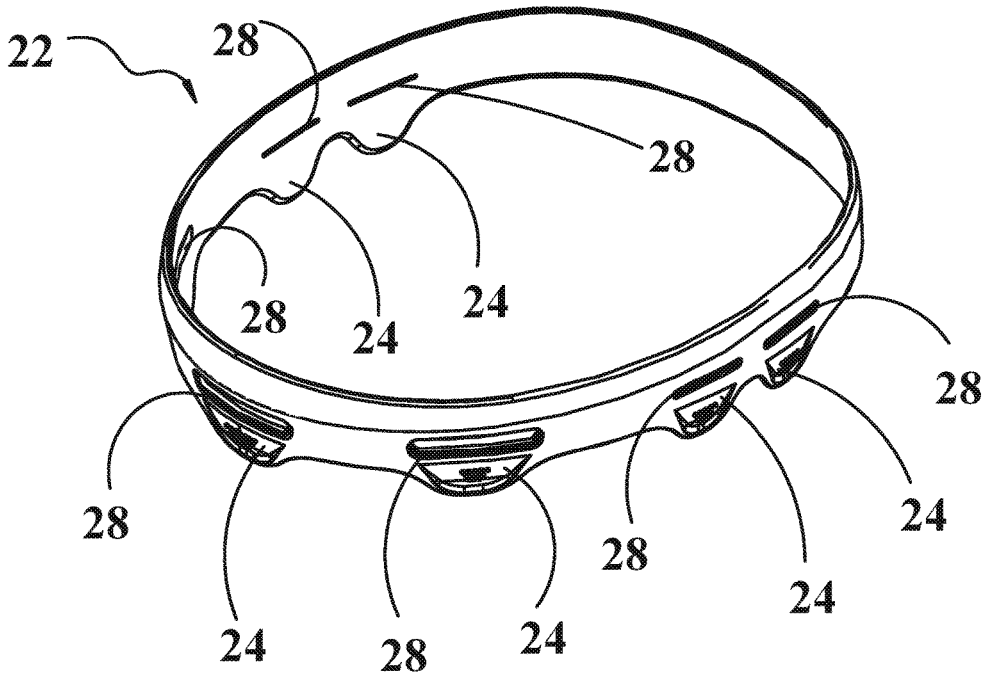
FIG. 1A is a schematic isometric view demonstrating an exemplary complexion and neck treatment band (CNTB) of the invention showing its main structural features.
Figure 1B:
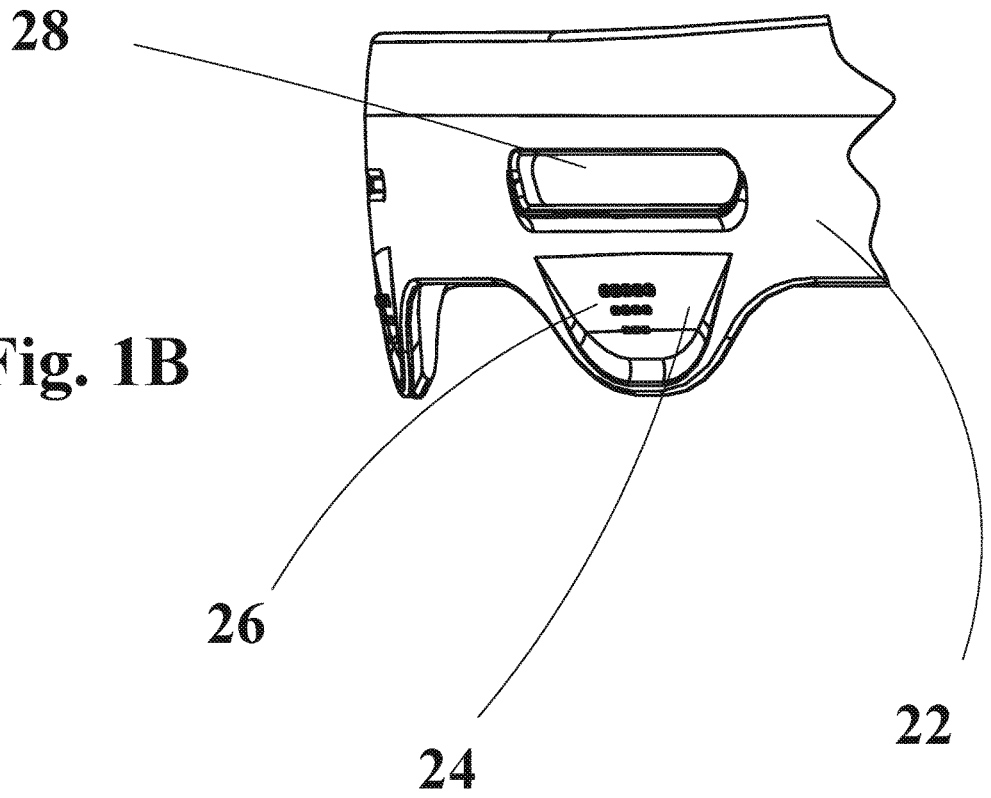
FIG. 1B is a schematic isometric view of a portion of the CNTB of the invention emphasizing the stretch lobe and associated skin surplus window.

In a preferred embodiment of the invention one or more SSWs 28 as can be seen in FIG. 1A and more clearly in FIG. 1B, are disposed in the main body of the CNTB above one or more of the SLs. The function of the SSW is to allow surplus skin folds to collect, as the skin below the CTB stretches upwards. The localized pull effect of lobes 24 may take place even without the SSW but the place to accumulate slack skin provided by the SSW improves the procedure. The length of the SSWs may vary but is typically similar to the length of the base of the SLs, it may be a few centimeters long. As to the width of the SSWs, (i.e. the vertical dimension), this also has no preferred measurement but is typically to range within of a few millimeters.

Longitudinal Slits (or Windows)

Figure 2:
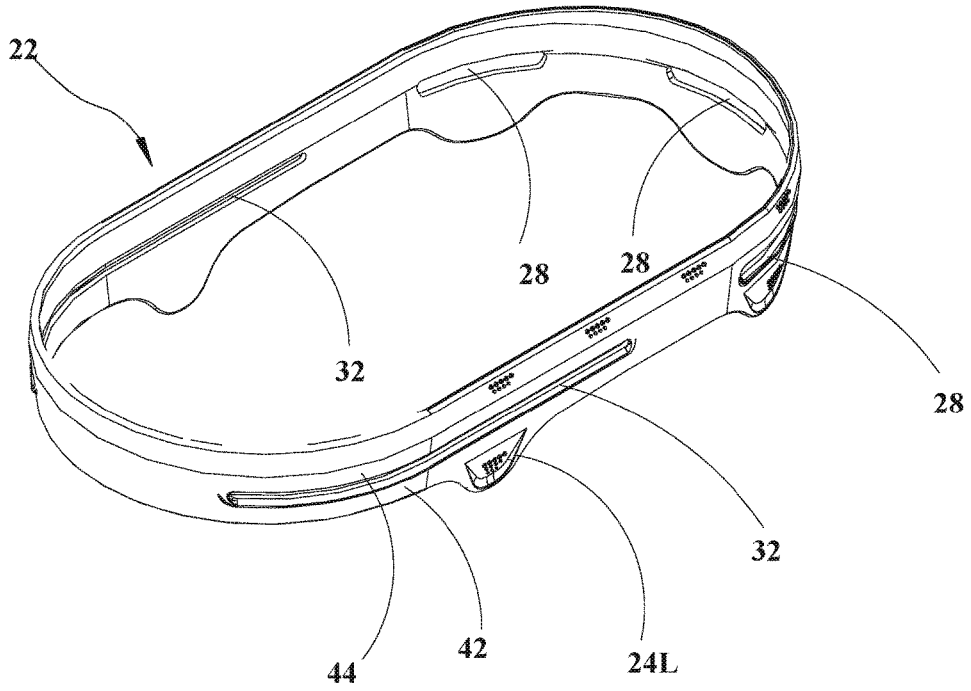
FIG. 2 is a schematic isometric view of an embodiment demonstrating parting longitudinal slits (PLSs).

Although the SSWs 28 constitute longitudinal slits in the CNTB, in another embodiment of the invention, slits longer than described hereinabove are disposed in the CNTB. As described in FIG. 2. While the SSBs 28 are concentrated at the frontal aspect of CNTB 22, two parting longitudinal slits (PLSs) 32 are disposed at the flanks of CNTB 22, i.e. the two sides positioned against the ears, respectively, as a general indication. The role of the PLS is to facilitate the deploying of the CNTB over the ears of the user so that the ears can protrude through PLSs 32. Additionally, the sector of the CNTB, i.e. longitudinal sector 42 residing below the PLS 32 can be pulled down (vertically) enlarging (widening vertically) the PLS, thereby not only allowing the ears to protrude through the widened PLS 32, but also bringing the lower sector complete with one or more (SLs) 24L towards specific regions of the complexion typically in the region below the ears and neck. Concurrently, the longitudinal sector 44, above PLS 32 remains in place forming a part of the anchorage of the CNTB on the head. The length of the PLSs is typically greater than the length of the SSWs, it has to take into account the fact that a portion of the CNTB or more correctly, two symmetrically opposing portions, on both sides of the head, are to be vertically spread apart from the CNTB and to allow the ears of the user free access through the parted slit. Also, in general, the existence of SSWs and the PLSs are not mutually exclusive in the same region of the same CNTB. Although both SSWs and PLSs may be disposed along the CNTB, they may be both indistinguishable as the length (horizontal dimension) of the PLSs may be similar to the length of the SSWs, especially as there is no strict definition of length, or the length may not be uniform among the PLSs or among the SSWs. Thus, although the PLSs are to be long enough to establish convenient passage to the ears and vertical splitting of the longitudinal sectors on both flanks of the PLS, confusion of the observer may be inevitable.

Internal and External Surfaces of the CNTB

Inner Surface

In order to enhance the skin stretching effect, the inner face of the CNTB may be made to adhere to the skin by specifically enhancing the skin—adhering properties of the inner face of the CNTB. It has been found that using a smoothed out and especially polished CNTB internal surface assists the adhesion to the skin and therefore makes the stretching more efficient. In order to achieve such a commercial production, the moulds in which the CNTBs are produced should be polished in those faces of the form which can confer advantageous properties to the inner surface of the CNTB.

Figure 3A:
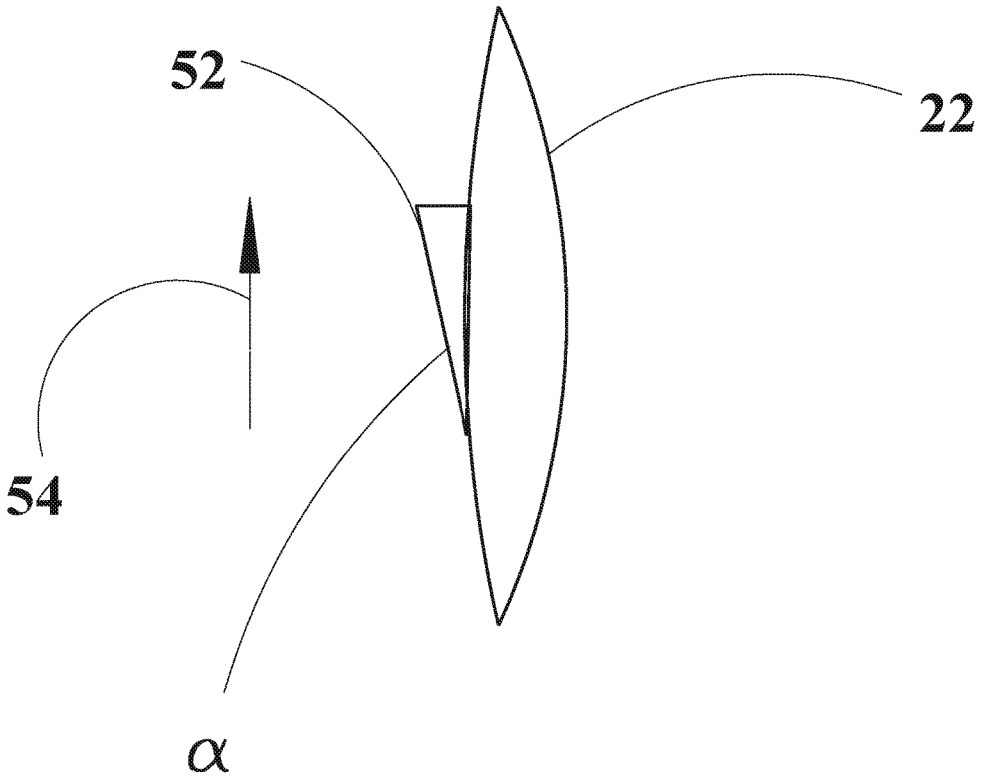
FIG. 3A is a schematic cross sectional view of an embodiment of a CNTB of the invention featuring a ledge formation.
Figure 3B:
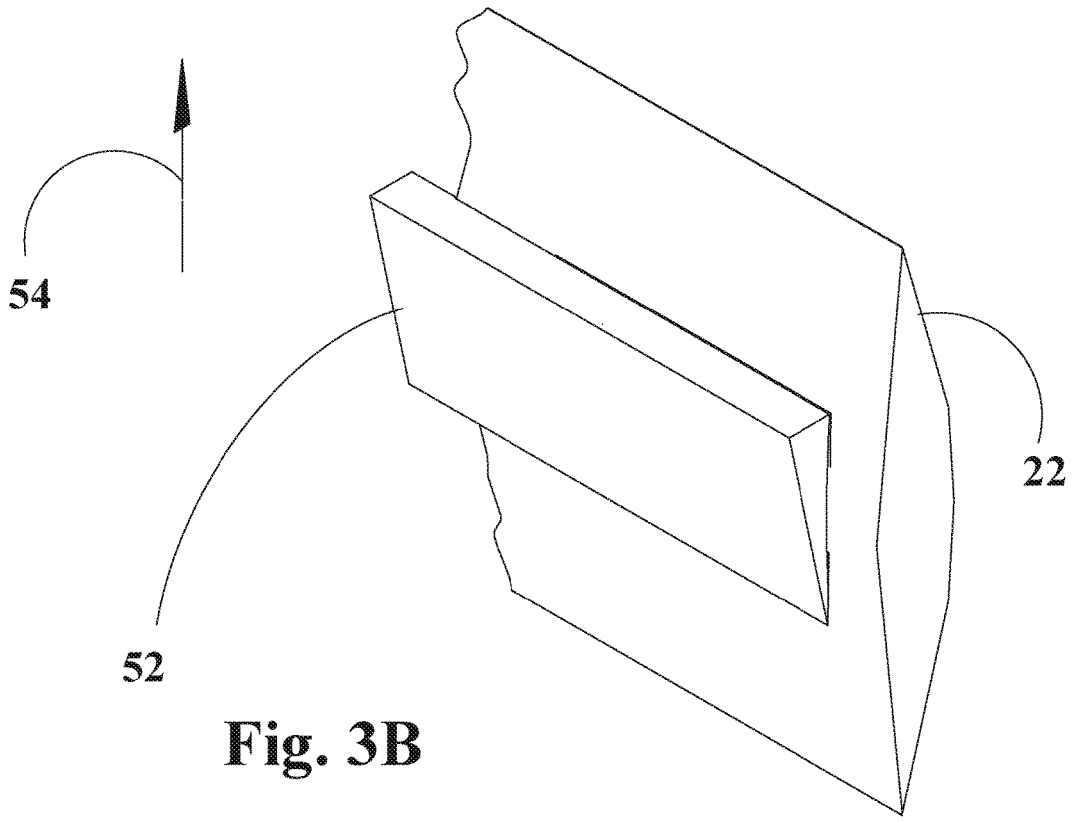
FIG. 3B is a schematic isometric view of an embodiment of the inner face of a CNTB of the invention demonstrating a ledge formation.

Another aspect of the system of the invention is a ledge formation which in some embodiments is implemented. This aspect is explained with reference to FIGS. 3A-B. FIG. 3A is a cross sectional view of a sector of the CNTB in which the ledge formation is implemented. Ledge 52 is either a part of or attached to CNTB 22. Arrow 54 alludes to two properties of the device and method of the invention. One, the upward direction and two, the manner in which ledge 52 operates with the skin of the complexion and neck. Accordingly, as the CNTB is applied (donned), first it is pulled downwards, in the direction of the gravitational pull. Then, it is pushed upwards, against the gravitational pull, in the direction of arrow 54. Ledge 52, now engaged with the skin due to the tight fitting of CNTB 22 is able to enhance the pull of the CNTB in the upward (vertical) direction. In the figure, the relative dimensions of the ledge and especially angle $\alpha$ may be exaggerated for the sake clarity of explanation. The value of angle $\alpha$ may be from 0 to about 30 degrees. Isometrically, the ledge formation is described in FIG. 3B. The Figure shows that the ledge roughly spans the sector in the figure. Indeed, in some embodiments the ledge spans around the entire inner face of the CNTB, but other options are viable as well. For example, ledge sections may be formed exclusively above lobes 24. Any other distribution of ledge sections is applicable.

Outer Surface

Generally, the outer surface of the CNTB does not receive special treatment apart from employing the structural features in some embodiments which assist the gripping action of the fingers when lobes 24 are to be manipulated.

Benefits of Using the System and Method of the Invention

As mentioned above in Jia Liu et al. Mechanical stretching stimulates collagen synthesis via down-regulating $SO_2$/AAT1 pathway. Sci. Rep. 6, 21112; doi: 10.1038/Srep 21112 (2016) Mechanical stress applied to human lung tissue was shown to stimulate collagen synthesis. Similarly with respect to mechanical effect, stretching skin tissue was shown to cause proliferation of human epidermal cells. (Soichiro Yano et al. "Mechanical stretching iii vitro regulates signal transduction pathways and cellular proliferation in human epidermal keratinocytes." J. Invest. Dermatol. 122: 783-790, 2004)

Exposing Hidden Skin Surfaces within Wrinkles

As has been shown by J. L. Contet-Audonneau et al. in "A histological study of human wrinkle structure: comparison between sun-exposed areas of the face, with or without wrinkles and sun-protected areas" (Br. J. of Dermatol. 1999: 140: 1038-1047 wrinkle structures. The article shows how wrinkles conceal skin portions at the folds and at the bottom of the wrinkle. In this respect, the use of the CNTB of the invention, facilitates straightening wrinkles for a period during which ointments, creams etc. are applied to the stretched skin enhancing penetration into wrinkled tissue.

ADDITIONAL EMBODIMENT OF THE SYSTEM OF THE INVENTION

Although the preferred embodiments for the system of the invention would use a complete band of rubbery or otherwise stretchable material to make the CNTB adhere to the skin associated with the complexion and neck. Specific materials that can be used to manufacture the CNTB are latex (or natural rubber), synthetic rubber, silicone rubber, and elastomers in general. Other option may be provided to achieve similar ends.

As regards forms rather than substance, incomplete CNTB, such that the band itself is discontinuous, and may be fastened to form a continuous circle by implementing temporary coupling elements to loose ends, such as hook and loop fasteners (Velcro®) and or various pins and clips, hitch pins etc.

What is claimed is:

1. A complexion and neck treatment band for a user, by which general stretch is applied to the skin of said complexion, wherein said band is adapted to fit around the head of said user, to encircle it and is made out of skin adhering material, forming a tight fit with said skin of said complexion wherein said complexion and neck treatment band includes at least three stretch lobes that each project downwards for finger gripping and pulling down for applying stretch to said skin, and wherein at least one skin surplus window is disposed within said band above at least one of said at least three stretch lobes to allow slack skin formed by localized stretching of said lobes to collect therein.

2. The complexion and neck treatment band as in claim 1 wherein said tight fit is achieved by the donning of a complete flexible band stretched around said head of said user.

3. The complexion and neck treatment band as in claim 2 wherein a ledge formation is disposed longitudinally at the inner side of said band.

4. The complexion and neck treatment band as in claim 1 wherein at least one of said lobes has surface structured features on its outer surface to assist the gripping action of the fingers.

5. The complexion and neck treatment band as in claim 2 further comprising two sequential parting longitudinal slits (PLSs) longitudinally disposed within said complexion and neck treatment band.

6. A method for applying stretch to the skin associated with the face and neck of a user, by applying a skin adhering band said method comprising the steps of:

donning a complexion and neck treatment band;

attaching said complexion and neck treatment band to the skin of said user;

applying a localized stretch in a place selected by said user by gripping at least one stretch lobe;

stretching said at least one gripped lobe further downwards, causing deformation of said at least one stretch lobe of said complexion and neck treatment band;

adhering said stretched stretch lobe to the skin, and further releasing said at least one gripped stretch lobe and wherein at least one skin surplus window is disposed within said band above said at least one stretch lobe to allow slack skin formed by localized stretching of said lobes to collect therein.

* * * * *